US006799578B2

(12) United States Patent
Snaidr et al.

(10) Patent No.: US 6,799,578 B2
(45) Date of Patent: Oct. 5, 2004

(54) LOW SIDESTREAM SMOKE CIGARETTE WITH COMBUSTIBLE PAPER

(75) Inventors: Stanislav M. Snaidr, Mississauga (CA); E. Robert Becker, Wayne, PA (US)

(73) Assignee: Rothmans, Benson & Hedges Inc., Ontario (CA)

( * ) Notice: Subject to any disclaimer, the term of this patent is extended or adjusted under 35 U.S.C. 154(b) by 85 days.

(21) Appl. No.: 09/954,432

(22) Filed: Sep. 18, 2001

(65) Prior Publication Data

US 2002/0062834 A1 May 30, 2002

Related U.S. Application Data

(60) Provisional application No. 60/233,440, filed on Sep. 18, 2000.

(51) Int. Cl.[7] ..... A24D 1/02

(52) U.S. Cl. ..... 131/365; 131/349; 131/360; 131/334

(58) Field of Search ..... 131/334, 349, 131/360, 365; 162/139

(56) References Cited

U.S. PATENT DOCUMENTS

| | | | | |
|---|---|---|---|---|
| 2,755,207 A | | 7/1956 | Frankenburg | |
| 3,220,416 A | | 11/1965 | Cohn | |
| 3,916,916 A | | 11/1975 | Bramucci | |
| 4,225,636 A | | 9/1980 | Cline et al. | |
| 4,248,251 A | | 2/1981 | Bryant, Jr. et al. | |
| 4,433,697 A | | 2/1984 | Cline et al. | |
| 4,561,454 A | | 12/1985 | Guess | |
| 4,685,477 A | | 8/1987 | Valdez | |
| 4,871,709 A | * | 10/1989 | Tatsushima et al. | 502/324 |
| 4,915,117 A | | 4/1990 | Ito | |
| 5,040,551 A | | 8/1991 | Schlatter et al. | |
| 5,105,838 A | | 4/1992 | White et al. | |
| 5,137,034 A | | 8/1992 | Perfetti et al. | |
| 5,213,779 A | * | 5/1993 | Kay et al. | 423/239 |
| 5,386,838 A | | 2/1995 | Quincy, III et al. | |
| 5,462,073 A | | 10/1995 | Bowen et al. | |
| 5,709,228 A | | 1/1998 | Cohen et al. | |
| 5,944,025 A | | 8/1999 | Cook et al. | |
| 5,976,490 A | * | 11/1999 | Wendelbo | 423/712 |

FOREIGN PATENT DOCUMENTS

| | | |
|---|---|---|
| CA | 604895 | 9/1960 |
| CA | 1 180 968 | 1/1985 |
| CA | 2 010 575 | 6/1990 |
| CA | 2 054 735 | 10/1991 |
| CA | 2 057 962 | 8/1999 |
| EP | 0 740 907 A1 | 6/1996 |
| FR | 1 583 284 A | 10/1969 |
| GB | 928089 | 6/1963 |
| WO | WO 95 34226 A | 12/1995 |
| WO | WO 96 22031 | 7/1996 |
| WO | WO 98 16125 | 4/1998 |
| WO | WO 99 53776 | 10/1999 |

* cited by examiner

*Primary Examiner*—Dionne A. Walls
(74) *Attorney, Agent, or Firm*—Banner & Witcoff, Ltd.

(57) ABSTRACT

A low sidestream smoke cigarette comprises a conventional tobacco rod, and a combustible treatment paper having a sidestream smoke treatment composition. The treatment composition comprises in combination, an oxygen storage and donor metal oxide oxidation catalyst and an essentially non-combustible finely divided porous particulate adjunct for said catalyst.

68 Claims, 2 Drawing Sheets

LOW SIDESTREAM SMOKE CIGARETTE WITH COMBUSTIBLE PAPER

Benefit of the Sep. 18, 2000 filing date of the U.S. provisional application Ser. No. 60/233,440 by the same inventors and entitled "The Use Of An Oxygen Metal Oxide Catalyst To Reduce Cigarette Sidestream Smoke" is hereby claimed.

FIELD OF THE INVENTION

The invention relates to sidestream smoke reduction in burning cigarettes and the like. More particularly, the invention relates to a composition for use with cigarette paper, cigarette wrapper or wrapper for a cigar for treating and visably reducing sidestream smoke.

BACKGROUND OF THE INVENTION

Various attempts have been made to reduce or eliminate sidestream smoke emanating from a burning cigarette. The applicant developed various approaches to cigarette sidestream smoke control systems as described in its Canadian patents 2,054,735 and 2,057,962; U.S. Pat. Nos. 5,462,073 and 5,709,228 and published PCT applications WO 96/22031; WO 98/16125 and WO 99/53778.

Other sidestream smoke control systems have been developed which use filter material or adsorptive material in the tobacco, filter or paper wrapper. Examples of these systems are described in U.S. Pat. Nos. 2,755,207 and 4,225,636; EP patent application 0 740 907 and WO 99/53778. U.S. Pat. No. 2,755,207 describes a low sidestream smoke cigarette paper. The cigarette paper on burning yields a smoke substantially free of obnoxious components. The cigarette paper is cellulosic material in fibre form. It has intimately associated therewith a finely divided mineral type siliceous catalyst material. The cigarette paper which is essentially non-combustible and refractory remains substantially unchanged during combustion of the cigarette paper and functions like a catalyst in modifying the combustion of the paper. Suitable siliceous catalysts include acid-treated clays, heat-treated montmorillonite and natural and synthetic silicates containing some hydrogen atoms which are relatively mobile. Suitable mixed silica oxides include silica oxides with alumina, zirconia, titania, chromium oxide and magnesium oxide. Other silicas include the oxides of silicon and aluminum in a weight ratio of 9:1 of silica to alumina.

U.S. Pat. No. 4,225,636 describes the use of carbon in the cigarette paper to reduce organic vapour phase components and total particulate matter found in sidestream smoke. In addition, the carbon results in a substantial reduction in visible sidestream smoke emitting from a burning cigarette. Activated carbon is preferred as the carbon source. The use of the activated carbon results in a slight drop in visible sidestream smoke. Up to 50% of the cigarette paper may be finely divided carbon. The carbon-coated papers may be used as the inner wrap for the tobacco rod in combination with a conventional cigarette.

European patent application 0 740 907 published Nov. 6, 1996 describes the use of zeolites in the tobacco of the cigarette to alter the characteristics of the mainstream smoke and in particular remove various components from the mainstream smoke such as some of the tars. The zeolite as provided in the tobacco, also apparently change the characteristics of the sidestream smoke. The zeolites used were of a particle size between 0.5 mm to 1.2 mm.

Published PCT patent application WO 99/53778 describes a non-combustible sheet of treatment material for reducing sidestream smoke emissions. The sheet is used as a wrap and is applied over conventional cigarette paper of a conventional cigarette. The wrap has a very high porosity to allow the cigarette to burn at or close to conventional free-burn rates while at the same time reduce visible sidestream smoke emissions. The non-combustible wrap includes non-combustible ceramic fibres, non-combustible activated carbon fibres as well as other standard materials used in making the wrap. The wrap also includes zeolites or other similar sorptive materials and an oxygen donor/oxygen storage metal oxide oxidation catalyst. The non-combustible wrap provides an acceptable degree of sidestream smoke control, however, due to the non-combustible nature of the wrap, a charred tube remains.

U.S. Pat. Nos. 4,433,697 and 4,915,117 describe the incorporation of ceramic fibres in a cigarette paper manufacture. U.S. Pat. No. 4,433,697 describes at least 1% by weight of certain ceramic fibres in the paper furnish in combination with magnesium oxide and/or magnesium hydroxide fillers to reduce visible sidestream smoke emanating from the burning cigarette. The furnish of fibre pulp, ceramic fibres and fillers are used to make a paper sheet on conventional paper making machines. The ceramic fibres may be selected from the group of polycrystalline alumina, aluminum-silicate and amorphous alumina. A filler of magnesium hydroxide or magnesium oxide is used and is coated on or applied to the fibres of the sheet.

Ito, U.S. Pat. No. 4,915,117 describes a non-combustible sheet for holding tobacco. The thin sheet is formed from ceramic materials which upon burning produces no smoke. The ceramic sheet comprises a woven or non-woven fabric of ceramic fibre or a mixture of paper and ceramics thermally decomposed at high temperature. The ceramic fibre may be selected from inorganic fibres such as silica fibre, silica-alumina fibre, alumina fibre, zirconia fibre, or alumino borosilicate and glass fibre. The ceramic sheet is formed by binding these materials by inorganic binders such as silica gel or alumina gel. The fibres are a preferably 1 to 10 micrometers in diameter.

Sol gels have been applied to conventional cigarette paper in order to reduce sidestream smoke, particularly sol gels made from a magnesium aluminate, calcium aluminate, titania, zirconia and aluminum oxide, as described in Canadian Patent 1,180,968 and Canadian Patent application 2,010,575. Canadian Patent 1,180,968 describes the application of magnesium hydroxide in the form of an amorphous gel as a cigarette paper filler component to improve ash appearance and sidestream smoke reduction. The magnesium hydroxide gel is coated on or applied to the fibres of the sheet of the cigarette paper. Canadian patent application 2,010,575 describes the use of gels produced by a solution gelation or sol-gel process for controlling the combustion of wrappers for smoking articles. The gels may be applied as coatings to paper fibres before the paper is formed into wrappers. The wrappers are useful for reducing visible sidestream smoke. The metal oxides for the sol gels may be aluminum, titanium, zirconium, sodium, potassium or calcium.

Catalysts have also been directly applied to cigarette paper, such as described in Canadian Patent 604,895 and U.S. Pat. No. 5,386,838. Canadian Patent 604,895 describes the use of platinum, osmium, iridium, palladium, rhodium and rhuthenium in the cigarette paper. These metals function as oxidation catalysts to treat vapours arising from combustion of the paper wrapper. Optimum catalytic effect has been provided by the metal palladium. The metal particles in a suitable medium are dispersed onto the face of a paper wrapper before it is applied to the cigarette.

U.S. Pat. No. 5,386,838 describes the use of a sol solution comprising a mixture of iron and magnesium as a smoke suppressive composition. The smoke suppressive composition is made by co-precipitating iron and magnesium from an aqueous solution in the presence of a base. The iron magnesium composition demonstrates high surface area of approximately 100 $m^2/g$ to approximately 225 $m^2/g$ when heated to a temperature between 100 and approximately 500° C. The iron magnesium composition may be added to paper pulp which is used to make smoke suppressive cigarette paper. The iron magnesium composition apparently functions as an oxidation catalyst and reduces the amount of smoke produced by the burning cigarette. The catalyst may also be applied to the tobacco, for example, as described in U.S. Pat. No. 4,248,251, palladium, either in metallic form or as a salt, may be applied to the tobacco. The presence of palladium in tobacco reduces the polycyclic aromatic hydrocarbons in the mainstream smoke. Palladium is used in combination with an inorganic salt or nitric or nitrous acid. Such nitrates include lithium, sodium, potassium, rubidium, cesium, magnesium, calcium, strontium, lanthanum, cerium, neodymium, samarium, europium, gadolinium, terbium, dysprosium, erbium, scandium, manganese, iron, rhodium, palladium, copper, zinc, aluminum, gallium, tin, bismuth, hydrates thereof and mixtures thereof. Catalysts have also been used in tubes to reduce sidestream smoke such as described in published PCT application WO 98/16125.

Catalytic materials have been used in aerosol types of cigarettes which do not produce sidestream or mainstream smoke per se, but instead a flavoured aerosol. Examples of these aerosol cigarettes include those described in U.S. Pat. Nos. 5,040,551, 5,137,034 and 5,944,025, which use catalysts to provide the necessary heat generation to develop the aerosol. Such catalyst systems include oxides of cerium, palladium or platinum.

Although the prior art contemplates various sidestream smoke control systems, none of them have provided a system which effectively reduces sidestream smoke by simply incorporating active components in the combustible cigarette paper so that the cigarette burns like a normal cigarette without appreciably affecting cigarette taste. Accordingly, this invention provides a sidestream smoke control system which not only looks and tastes like a conventional cigarette but as well, in accordance with aspects thereof, ashes like a normal cigarette.

SUMMARY OF THE INVENTION

The invention provides for a significant reduction in sidestream smoke in its various applications. It has been found that such reduction in sidestream smoke can surprisingly be achieved by the combined use in a sidestream smoke treatment composition, of an oxygen storage and donor metal oxide oxidation catalyst and an essentially non-combustible finely divided porous particulate adjunct for the catalyst where said oxygen storage and donor metal oxide oxidation catalyst releases oxygen at free burn rate temperatures of the cigarette. This composition may be used with normal combustible cigarette paper to provide acceptable free-burn rates while minimizing or virtually eliminating visible sidestream smoke.

The adjunct for the catalyst may be any suitable essentially non-combustible particulate material such as clays, carbon materials such as milled carbon fibres, mineral based materials such as metal oxides and metal oxide fibres, ceramics such as milled ceramic fibres and high surface area porous particles. In this respect, the catalyst adjunct is most preferably an essentially non-combustible high surface area sorptive material such as activated carbon or zeolites. In a most preferred embodiment of the invention, the sorptive materials are zeolites and in particular, hydrophobic zeolites. The zeolites are especially preferred when used in combination with a cerium based catalyst.

The sidestream smoke treatment composition may be applied in various ways. The composition may be used as a filler in the manufacture of a cigarette paper, impregnated in a cigarette paper, or as a coating(s) or a layer(s) on the exterior and/or interior of a cigarette paper. The resultant low sidestream smoke treatment cigarette paper may have a range of porosities from very low porosities of about 0.5 Coresta units through to high porosity of about 1,000 Coresta units. Preferred porosities are usually less than 200 Coresta units and most preferred porosities are usually in the range of about 30 to 60 Coresta units. It is appreciated that such treated paper may be used as a multiple wrap. The treated paper may be applied as an outer wrap over a cigarette having conventional cigarette paper.

The sidestream smoke treatment composition may be applied as a coating on both or either side of a paper for a multiple—usually a double—wrapped cigarette, or impregnated into the paper, or may be incorporated as a filler in the manufacture of the paper for single or multiple wraps of cigarette paper. In a double wrap arrangement, the sidestream smoke treatment composition may in one embodiment be sandwiched between two papers. In a further double wrap embodiment, the sidestream smoke treatment composition may be coated on the side of a paper adjacent the tobacco rod where different loadings of the composition sandwiched in between the two papers may be provided. In still a further double wrap embodiment, the sidestream smoke treatment composition may be coated onto both sides of the paper placed on the tobacco rod, where different loadings may be provided. A second paper may be used as a further wrap thereover. The cigarette treatment paper may have typical ashing characteristics which is a significant benefit over non-combustible cigarette tubes and wraps of the prior art. The treatment paper may be a conventional cellulose based cigarette paper which, with the treatment composition, surprisingly does not add to the sidestream smoke.

It has been found that in order to optimize sidestream smoke reduction, the catalyst and adjunct are used in combination. The two components may be co-mingled as a filler, for example, in the manufacture of cigarette paper. Alternatively, when used as a coating, the catalyst and the adjunct are also co-mingled, usually as a slurry, and applied as such. In respect of the preferred embodiments, and in particular, the combined use of cerium with zeolite, the materials may be applied as individual contacting thin layers to develop a multilayer coating. Such layers may be of a thickness usually less than that of conventional cigarette paper and due to their intimate contacting nature, function as though they were combined and co-mingled.

According to other aspects of the invention, a low sidestream smoke cigarette comprises a conventional tobacco rod and a combustible treatment paper having a sidestream smoke treatment composition for said rod, said treatment composition comprises in combination, an oxygen storage and donor metal oxide oxidation catalyst and an essentially non-combustible finely divided porous particulate adjunct for said catalyst where said oxygen storage and donor metal oxide oxidation catalyst releases oxygen at free burn rate temperatures of the cigarette.

According to an aspect of the invention, a low sidestream smoke cigarette comprising a conventional tobacco rod, and a combustible treatment paper having a sidestream smoke treatment composition comprising cerium oxide which functions both as an oxygen storage and donor metal oxide oxidation catalyst and an essentially non-combustible finely divided porous particulate adjunct for the catalyst where said oxygen storage and donor metal oxide oxidation catalyst releases oxygen at free burn rate temperatures of the cigarette. According to another aspect of the invention, a furnish composition for use in making a cigarette treatment paper for reducing sidestream smoke emitted from a burning cigarette comprises in combination an oxygen storage and donor metal oxide oxidation catalyst and an essentially non-combustible finely divided porous particulate adjunct where said oxygen storage and donor metal oxide oxidation catalyst releases oxygen at free burn rate temperatures of the cigarette.

According to a further aspect of the invention, a low sidestream smoke cigarette comprising a conventional tobacco rod, and a combustible treatment paper having a sidestream smoke treatment composition, said treatment composition comprising in combination, an oxygen storage and donor metal oxide oxidation catalyst and an essentially non-combustible zeolite adjunct for said catalyst where said oxygen storage and donor metal oxide oxidation catalyst releases oxygen at free burn rate temperatures of the cigarette.

According to a further aspect of the invention, a slurry composition for application to cigarette paper for reducing sidestream smoke emitted from a burning cigarette comprises in combination with an oxygen storage and donor metal oxide oxidation catalyst, an essentially non-combustible finely divided porous particulate adjunct for said catalyst where said oxygen storage and donor metal oxide oxidation catalyst releases oxygen at free burn rate temperatures of the cigarette.

According to another aspect of the invention, a combustible cigarette paper for use on a smokable tobacco rod of a cigarette for reducing sidestream smoke emitted from a burning cigarette, the cigarette treatment paper including a sidestream smoke treatment composition comprising in combination an oxygen storage and donor metal oxide oxidation catalyst and an essentially non-combustible finely divided porous particulate adjunct where said oxygen storage and donor metal oxide oxidation catalyst releases oxygen at free burn rate temperatures of the cigarette.

According to another aspect of the invention, a method for reducing sidestream smoke emitted from a burning cigarette, comprises treating sidestream smoke with a treatment composition carried by a combustible cigarette paper, said treatment composition comprising in combination, an oxygen storage and donor metal oxide oxidation catalyst and an essentially non-combustible finely divided porous particulate adjunct for said catalyst where said oxygen storage and donor metal oxide oxidation catalyst releases oxygen at free burn rate temperatures of the cigarette.

According to another aspect of the invention, a low sidestream smoke cigarette comprising a conventional tobacco rod and a combustible cigarette paper having and a sidestream smoke treatment composition associated with the cigarette paper, wherein said treatment composition reduces sidestream smoke by greater than about 90%. For ease of description, whenever the term cigarette is used, it is understood to not only include smokable cigarettes but as well any form of wrapped smokable tobacco product, such as cigars, or the like. Whenever the term treatment paper is used, it is understood to encompass combustible wrappers and the like which may be used on cigarettes, cigars and the like. The wrapper may be used as a single layer of cigarette paper or multiple layer of cigarette paper. The wrapper may be applied as the sole layer of cigarette paper or as a wrap over conventional cigarette paper of a cigarette. The treatment paper may include as its substrate conventional cigarette paper or similar combustible product with a wide range of porosities. The conventional tobacco rod encompasses tobacco compositions normally used in smokable cigarettes. These rods are to be distinguished from tobacco components used in aerosol cigarette.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
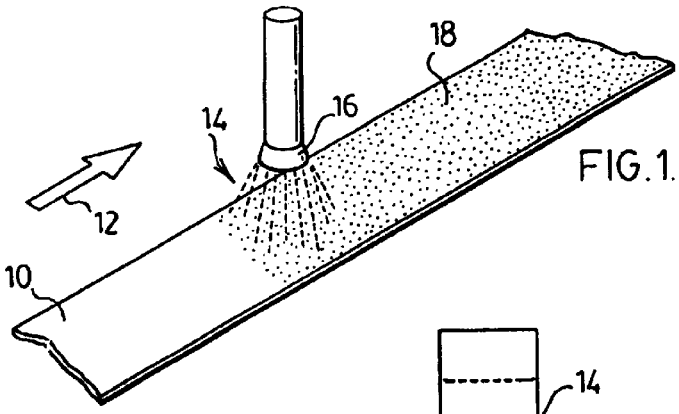
FIG. 1 is a schematic view of a spray technique for applying the treatment composition to a cigarette paper.

In its simplest form, the sidestream smoke treatment composition invention comprises, an oxygen storage and donor metal oxide oxidation catalyst used in combination with a non-combustible finely divided porous particulate adjunct for the catalyst. It has been unexpectantly found that when these two components are used in combination either alone or with other constituents, a very surprising degree of sidestream smoke control is provided, without affecting the taste of the cigarette and, in most embodiments, without affecting the manner in which the cigarette burns. Furthermore, since this composition may be applied as a coating to or filler within the cigarette paper, the resultant low sidestream smoke cigarette looks like a conventional cigarette.

The adjunct may be any suitable essentially non-combustible, finely divided porous particulate material which does not affect the flavour and taste of the mainstream smoke and does not give off any undesirable odours in the sidestream vapours. The particulate material is physically stable at the elevated temperatures of the burning cigarette coal. The porous adjunct has a high surface area, usually in excess of about 20 $m^2/g$ of adjunct. In order for the particles to achieve such surface areas, they must be porous. Preferably, the porous adjunct has pores with an average diameter of less than 100 nm (1000 Å). More preferably, the pores have an average diameter of less than 20 nm (200 Å) and even more preferred are pores with an average diameter of 0.5 to 10 nm (5–100 Å). With zeolite based materials, the pores have an average diameter in the range of about 0.5 to 1.3 nm (5–13 Å).

It is preferred that the particulate adjunct has an average particle size of less than about 30 μm, more preferably less than about 20 μm and most preferably about 1 μm to 5 μm. Non-combustible materials may be porous clays of various categories commonly used in cigarette paper manufacture, such as the bentonite clays or treated clays having high surface areas. Non-combustible carbon materials may also be used including milled porous carbon fibres and particulates. Various metal oxides may be used such as porous monolithic mineral based materials which include zirconium oxide, titanium oxides, cerium oxides, aluminum oxides such as alumina, metal oxide fibres such as zirconium fibres and other ceramics such as milled porous ceramic fibres and mixtures thereof, such as zirconium/cerium fibres. In respect of cerium oxide, it has been found that it is capable of functioning as a finely divided adjunct and as an oxygen storage and donor cerium oxide oxidation catalyst. Other adjunct materials include high surface area materials such as activated carbon and zeolites.

The adjunct may also comprise high surface area highly sorptive materials which are non-combustible, inorganic finely divided particulate, such as molecular sieves which include zeolites and amorphous materials such as silica/alumina and the like. The most preferred are zeolites such as silicalite zeolites, faujasites X, Y and L zeolites, beta zeolites, Mordenite zeolites and ZSM zeolites. Preferred zeolites include hydrophobic zeolites and mildly hydrophobic zeolites which have affinity for hydrophobic and mildly hydrophobic organic compounds of such sidestream smoke. The zeolite materials provide a highly porous structure which selectively absorbs and adsorbs components of sidestream smoke. The highly porous structure generally comprise macropores amongst the particles and micropores within the particles which branch off of the macropores. It is believed that the captured components in the macropores and micropores in presence of the cerium oxide or other suitable oxidation catalysts at the high temperature of the burning cigarette, converts such captured components into oxidized compounds which continue to be trapped in the adsorbent material or are released as invisible gases which have sufficiently low tar and nicotine levels so that the sidestream is invisible or at a low desired level.

The zeolite materials may be characterized by the following formula: $M_mM'_nM''_p[aAlO_2 \bullet b\ SiO_2 \bullet cTO_2]$
wherein M is a monovalent cation, M' is a divalent cation, M" is a trivalent cation, a, b, c, n, m, and p are numbers which reflect the stoichiometric proportions, c, m, n or p can also be zero, Al and Si are tetrahedrally coordinated Al and Si atoms, and T is a tetrahedrally coordinated metal atom being able to replace Al or Si, wherein the ratio of b/a of the zeolite or the zeolite-like material, has a value of about 5 to 300 and the micropore size is within the range of about 0.5 to 1.3 nm (5 to 13 Å).

Preferred zeolites of the above formula, have the specific formulas of faujasites ($(Na_2, Ca, Mg)_{29}[Al_{58}Si_{134}O_{384}] \bullet 240\ H_2O$; cubic), β-zeolites ($Na_n[Al_nSi_{64-n}O_{128}]$ with n<7; tetragonal), Mordenite zeolites ($Na_8[Al_8Si_{40}O_{96}] \bullet 24\ H_2O$; orthorhombic), ZSM zeolites ($Na_n[Al_nSi_{96-n}O_{192}] \sim 16\ H_2O$ with n<27; orthorhombic), and mixtures thereof.

It is appreciated that various grades of the sorptive material may be used. This is particularly true with gradients of zeolites which can be custom designed to selectively adsorb, for example, high boiling point materials, mid boiling point materials and low boiling point materials. This can lead to layers of the zeolite composition where the cerium or other suitable catalyst contemplated by this invention is preferably dispersed throughout these layers. The layers may then be bound on cigarette paper for the tobacco rod by using a binder or an adhesive which may be, for example, polyvinylacetate, polyvinyl alcohol, carboxy methyl cellulose (CMC), starches and casein or soya proteins, and mixtures thereof.

The oxygen donor and oxygen storage metal oxide oxidation catalyst is most preferably selected from the transition metal oxides, rare earth metal oxides, (such as scandium, yttrium, and lanthanide metal series, i.e. lanthanum) and mixtures thereof. It is appreciated that the catalyst may be in its metal oxide form or a precursor of the metal oxide which, at the temperature of the burning cigarette, is converted to a metal oxide to perform its catalytic activities. The selected oxygen donor and oxygen storage metal oxide oxidation catalyst in its catalytic form releases oxygen at free burn rate temperatures of the burning cigarette. The transition metal oxides may be selected from oxides of the group of metals from the Periodic Table consisting of groups IVB, VB, VIB, VUB, VIII and IB metals and mixtures thereof. Preferred metals from the transition metal group are oxides of iron, copper, silver, manganese, titanium, zirconium, vanadium and tungsten and from the rare earth group are oxides of lanthanide metals such as oxides of cerium. For example, cerium may be used in admixture with any one of the transition metals. It is appreciated that other metal oxide oxidation catalysts may be used with the oxygen storage and oxygen donor type of catalyst. Such other metal catalysts include precious metals and metals from groups BA, WA and mixtures thereof. Examples include tin, platinum, palladium and mixtures thereof.

The cerium catalyst precursor may be in the form of a cerium salt such as a cerium nitrate or other dispersible forms of cerium which are applied in solution or sol to the sorptive material and which is converted to cerium oxide at the high temperature of the burning cigarette to then function as a catalyst. For purposes of describing the invention, the term catalyst is intended to include any catalyst precursor.

The catalyst such as, cerium oxide, is used in combination with the adjunct material. It has been found that when the two are used separate from one another or in spaced apart, non-adjacent layers, the ability to control sidestream smoke is greatly reduced. Although in certain arrangements, some sidestream smoke control can be achieved. Preferably the catalyst is substantially adjacent the adjunct material. This can be achieved by co-mingling the particulate catalyst, in admixture with the adjunct, contacting a layer of the adjunct with a catalyst layer, coating the catalyst on the adjunct or impregnating the catalyst within or on the porous surfaces of the adjunct, to bring about the desired surprising sidestream smoke control properties. It should be appreciated that many other constituents may be used in addition to the combination of the oxygen storage and oxygen donor metal oxide oxidation catalyst and the adjunct. Additional additives may be used to further enhance the treatment of the sidestream smoke or alter other characteristics of the cigarette. Such additional additives may be mixed in with the treatment composition or used elsewhere in the cigarette construction, providing ofcourse that such additives do not appreciabley impact negatively on the ability of the treatment composition to treat the sidestream smoke.

The composition may be formulated in a variety of ways which achieve co-mingling of the cerium with the adsorptive material. For example, the adsorptive material may be sprayed with or dipped in a cerium salt solution such as cerium nitrate or cerium sol to impregnate the surface of the adsorptive material with cerium. Cerium oxide may be prepared as a separate fine powder which is mixed with the fine powder of the adsorptive material. It is particularly preferred that the catalyst powders have an average particle size of less than about 30 $\mu$m and preferably less than 20 $\mu$m and most preferably of about 1.0 to 5 $\mu$m to ensure intimate mixing and co-mingling of the materials.

As a general guide to selecting catalyst particle size and surface area, it is appreciated by one skilled in the art that the selected catalyst has a surface area which is such to ensure that the catalyst action sites are available to the migrating sidestream smoke components. This may result in catalyst particle size being greater than 30 $\mu$m in certain embodiments, if the catalyst particles are properly distributed to achieve the necessary degree of sidestream smoke component oxidation.

It has been surprisingly found that the cerium oxide is one of the few metal oxides which can perform both functions of the invention, namely as the oxygen storage and oxygen donor catalyst and as well as the adjunct. The porous cerium oxide particles can be made with the high surface areas and an average particle size required for the adjunct. The cerium oxide is used with the cigarette paper in a first amount as the catalyst and a second amount as the adjunct in the treatment composition. Such amounts of the cerium oxide correspond generally with the amounts used for the catalyst and adjunct in accordance with other aspects of the invention to make up the total loading.

The cerium may be formulated as a solution dispersion, such as cerium oxide sol, or the like and applied to the sorptive material such as zeolite. It is then dried and fired to provide cerium oxide particles fixed on the surfaces of the adsorptive material. When the cerium oxide particles are fixed to adjunct surfaces such as surfaces of zeolite, the average particle size may be less than about 1.0 $\mu$m. The relative amounts of cerium oxide fixed to the zeolite may range from about 1% to 75% by weight based on the total equivalent cerium oxide and zeolite content. The preferred relative amounts of cerium oxide fixed to the zeolite may range from about 10% to 70% by weight based on the total equivalent cerium oxide and zeolite content.

A preferred method for making the combination product of cerium oxide fixed on the surfaces of the zeolite is described in a co-pending U.S. provisional application, Serial No. 60/318,878, filed in the U.S. Patent Office on Sep. 14, 2001, entitled "A Process For Making Metal Oxide-Coated Micropourous Material" the subject matter of which is incorporated herein by reference.

Although a detailed specification for the manufacture of the combination product is provided in the above application, for ease of reference, the method generally involves making a catalytic cerium oxide-coated zeolite particulate material having at least 1% by weight of cerium oxide coated on outer surfaces of the zeolite particulate material, based on the total equivalent cerium oxide and zeolite content. In one aspect, the method generally comprises the steps of:

i) combining an amount of a colloidal dispersion of cerium oxide hydrate with a compatible zeolite particulate material to form a slurry, the amount of the colloidal dispersion being sufficient to provide, when heat treated as per step (ii), greater than 20% by weight of the cerium oxide, the zeolite particulate material having an average pore size of less than 20 Å and the colloidal dispersion having an average particle size of at least 20 Å, to position thereby, the colloidal dispersion on the outer surfaces of the zeolite; and ii) heat treating the slurry firstly, at temperatures below about 200° C. and secondly, above about 400° C., to fix the resultant cerium oxide on the outer surfaces of the zeolite particulate material, to provide a free flowing bulk particulate.

This product is available from AMR Technologies, Inc. of Toronto, Canada. Alternatively to this method, the adjunct sorptive material may be dipped in a solution of cerium salt and dried and heat treated to form the cerium oxide on the surfaces of the sorptive material.

The surprising activity of the sidestream smoke treatment composition permits its use in cigarette papers having a wide range of porosities. It has also been found that the composition does not have to be used in cigarette papers that just have high porosities. The treatment composition works equally well in papers with very low porosities of about 0.5 through to very high porosity of about 1,000 Coresta units. Preferred porosities are usually less than 200 Coresta units and most preferred porosities are usually in the range of about 30 to 60 Coresta units. It is appreciated that the paper may be used as a double or multiple wrap. The paper may be applied as an outer wrap over a cigarette having conventional cigarette paper. It is appreciated that depending upon the porosity, certain combinations of the catalyst and adjunct may work better than others.

Figure 2:
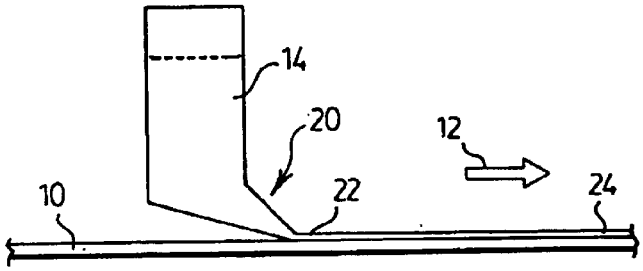
FIG. 2 is a schematic view of extruding a film of the treatment composition onto the cigarette paper.
Figure 3:
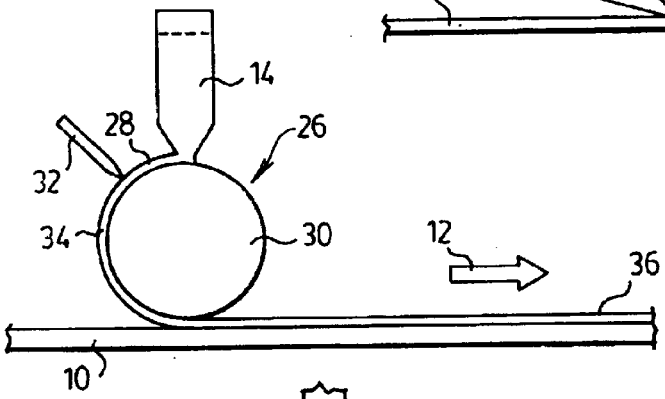
FIG. 3 is a schematic view of roll coating the treatment composition on cigarette paper.
Figure 4:
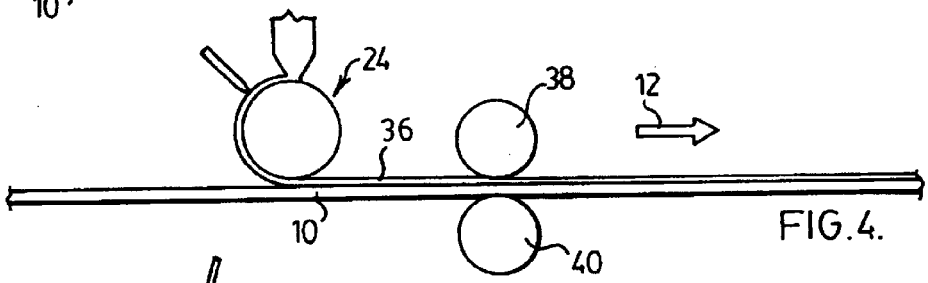
FIG. 4 is a schematic view of the impregnation of a coating of the treatment composition into the cigarette paper.

The composition may be simply sprayed onto either side or both sides of the cigarette paper and absorbed into the paper. As shown in FIG. 1, the paper 10 is conveyed in the direction of arrow 12. The treatment composition 14 as a slurry is sprayed by spray nozzle 16 onto the paper 10 to provide a coating 18 which is dried on the paper. Alternatively, the composition may be extruded as a film to the surface of the paper and may be used as a single or multiple wrap. As shown in FIG. 2, a film coating device 20 contains the slurried treatment composition 14. The film coater 20 lays a thin film 22 on the paper 10 which is conveyed in the direction of arrow 12. The film is dried to provide a coating 24 on the paper 10. With these arrangements, it is quite surprising that the visual sidestream smoke from a burning cigarette virtually disappears. The treatment composition may be applied to a conventional cigarette on the exterior of the cigarette paper. Coating may be achieved by a roller applicator 26, as shown in FIG. 3. The treatment composition 14 is applied as a layer 28 on the roller 30. A doctor knife 32 determines the thickness of a layer 34 which is then laid onto the paper 10 which is conveyed in the direction of arrow 12. The layer is then dried to form a coating 36 on the paper 10. Impregnation is achieved by using the coating roller 24 of FIG. 4 and the resultant layer 36 with paper 10 is passed in the direction of arrow 12 through pressure rollers 38 and 40 which force the layer of material into the paper 10 to thereby impregnate constituents of the treatment composition into the paper.

It is also understood by one of skill in the art that various other coating processes including transfer coating processes, may be used for making the treatment paper of the invention. In the transfer coating process, Mylar™ sheet or other suitable continuous sheet may be used to transfer a coating composition from the Mylar™ sheet to the surface of the cigarette paper. This type of transfer coating is useful when the substrate sheet may not readily accept the roll coating of a composition due to physical strength characteristics of the paper or the like.

Figure 5:
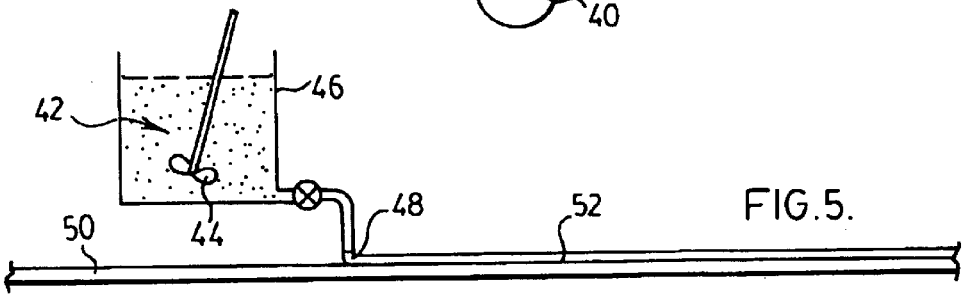
FIG. 5 is a schematic view of mixing the treatment composition with the paper pulp in the manufacture of cigarette paper.

A further alternative is to incorporate the treatment composition into the manufacture of paper. The composition may be introduced to the paper furnish as a slurry. With reference to FIG. 5, the treatment composition in the furnish 42 is stirred by stirrer 44 to form a slurry in the tank 46. The slurry is transferred in the conventional paper making manner and is laid as a layer 48 on a moving conveyor 50 to form the resultant cigarette paper 52. As a result the treatment composition is incorporated in the final paper product. Another alternative is to sandwich the treatment composition between paper layers to form a double cigarette paper wrap on tobacco rods. For example, the composition may be applied such as by the spraying technique of FIG. 1 on the interior of the outer paper or the exterior of the inner paper. Once the two papers are applied to the tobacco rod the composition as a layer is sandwiched between the two papers. Each paper may be of half of the thickness of conventional cigarette paper so that the double wrap does not add appreciably to the overall diameter of the cigarette as is readily handled by cigarette making machines.

Figure 6:
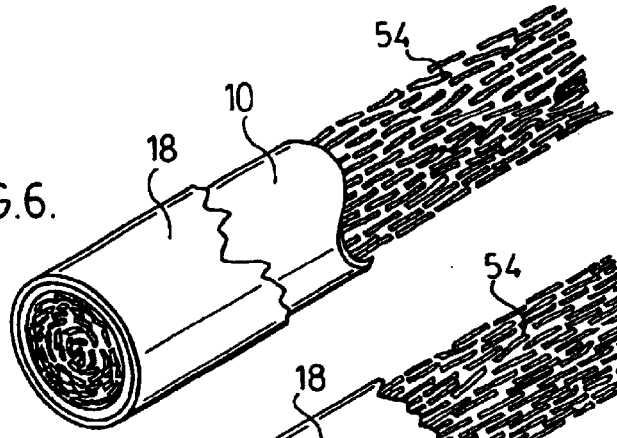
FIG. 6 is a perspective view of a tobacco rod having the treatment paper of this invention applied thereto.
Figure 7:
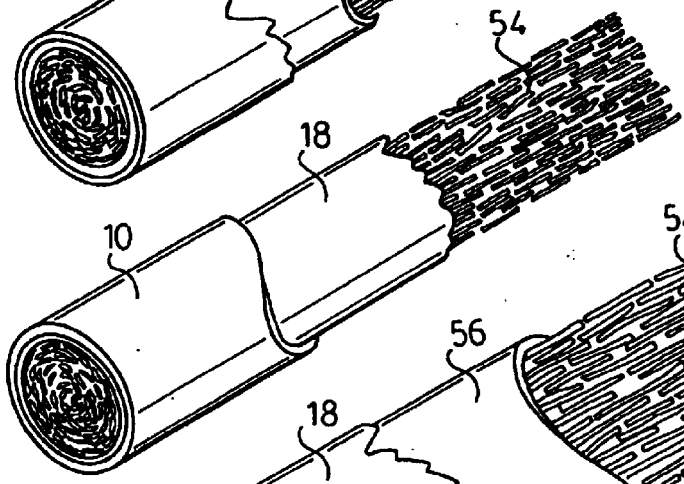
FIG. 7 shows an alternative embodiment of FIG. 6.

With reference to FIG. 6, the tobacco rod 54 has, for example, the cigarette paper 10 wrapped therearound with the coating 18 on the outside of the paper. Conversely, as shown in FIG. 7, the cigarette paper 10 can be applied with the coating 18 on the inner surface of the paper adjacent the tobacco rod 54.

Figure 8:
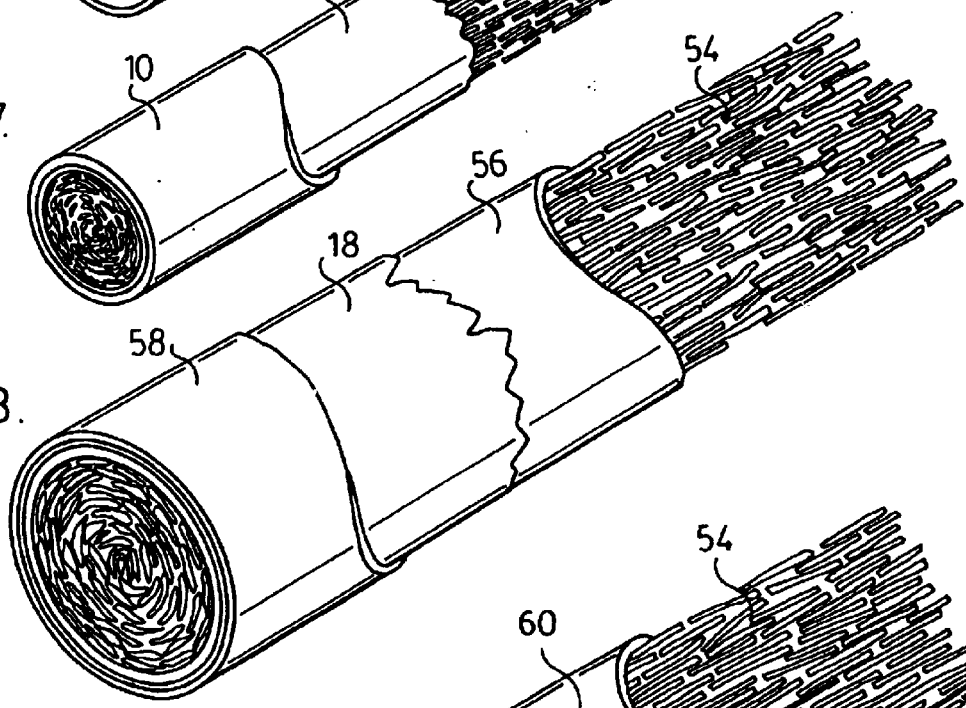
FIG. 8 is a perspective view of a tobacco rod having the treatment composition sandwiched between two layers of cigarette paper as applied to the tobacco rod.
Figure 9:
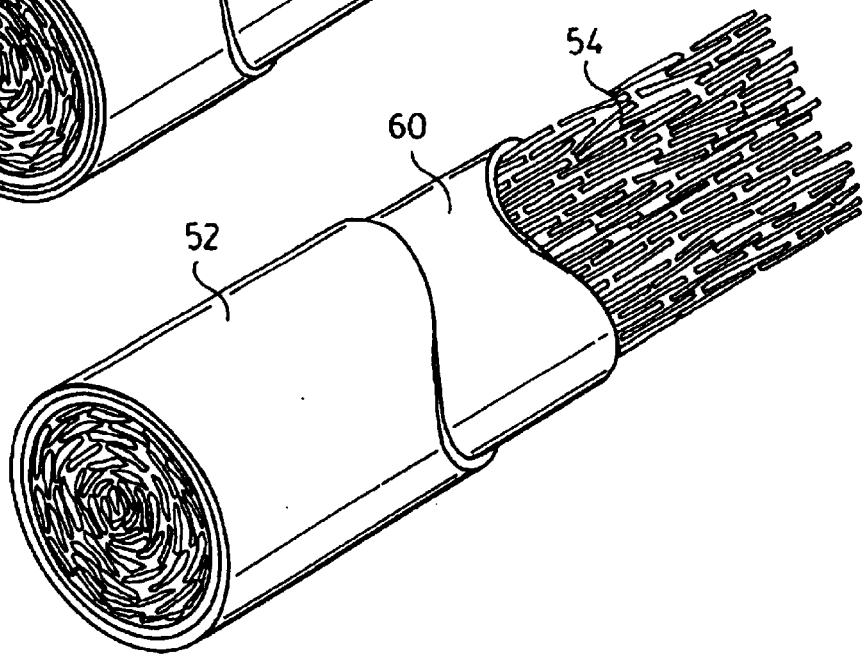
FIG. 9 is a perspective view of a double wrap for the tobacco rod where treatment paper is applied over conventional cigarette paper.

Another alternative, as shown in FIG. 8, is to sandwich the coating 18 between cigarette papers 56 and 58. The papers 56 and 58 with the intermediate coating 18 may be formed as a single cigarette wrapper which is applied to the tobacco rod 54. A further alternative is shown in FIG. 9 where the tobacco rod 54 is covered with conventional cigarette paper 60. Over the conventional paper 60 is the cigarette paper 52 of FIG. 5 with the treatment composition incorporated therein. It is also appreciated that paper 52 with the treatment composition incorporated therein may be applied directly to the tobacco rod 54.

As is appreciated by one of skill in the art, the aforementioned procedures for providing the sidestream smoke treatment composition within or onto a desired cigarette paper may be varied with respect to the loadings provided and the number of wraps used on a tobacco rod. For example, two or more papers with various loadings of the composition, on both sides of the papers, may be used such that the loading to one side is reduced, making the coating application easier.

With any of these combinations, it has been surprisingly found that sidestream smoke is virtually eliminated. At the same time, the cigarette paper demonstrates conventional ashing characteristics. It is particularly surprising that the simple application of the composition to the exterior of the cigarette paper can minimize to an almost undetectable level, visible sidestream smoke.

It is appreciated that depending upon the manner in which the composition is used and applied to a cigarette, various processing aids and mixtures thereof may be required to facilitate the particular application of the treatment composition. Such processing aids include laminating materials such as polyvinylalcohol, starches, CMC, casein and other types of acceptable glues, various types of binding clays, inert fillers, whiteners, viscosity modying agents, inert fibrous material such as zirconium fibres and zirconium/cerium fibres, such as described in U.S. provisional application Serial No. 60/318,614, filed Sep. 13, 2001, entitled "Zirconium/Metal Oxide Fibres" the subject matter of which is incorporated hereby by reference. Penetrating agents may also be employed to carry the composition into the paper. Suitable diluents such as water are also used to dilute the composition so that it may be spray coated, curtain coated, air knife coated, rod coated, blade coated, print coated, size press coated, roller coated, slot die coated, technique of transfer coating and the like onto a conventional cigarette paper.

Desirable loadings of the treatment composition onto or into the cigarette paper, wrapper or the like is preferably in the range of from about 2.5 g/m$^2$ to about 125 g/m$^2$. Most preferably the loading is in the range of about 2.5 g/m$^2$ to about 100 g/m$^2$. Expressed as a percent by weight, the paper may have from about 10% to 500% by weight and most preferably about 10% to 400% by weight of the treatment composition. While these loadings are representative for single paper, it is understood by one skilled in the art that these total loadings may be provided with the use of two or more papers.

The sidestream smoke reduction composition is used normally as a water slurry of the composition. The slurry may be incorporated in the furnish of the paper in the paper making process, or is coated onto the paper by various coating processes or impregnated into the paper by various impregnating methods. The preferred average particle size of the catalyst and adjunct for the slurry is in the range of about 1 $\mu$m to about 30 $\mu$m and most preferably about 1 $\mu$m to about 5 $\mu$m. The preferred relative amounts of catalyst fixed to the adjunct may range from about 1% to 75%, more preferably from about 10% to 70%, and even more preferably from about 20% to 70% by weight based on the total equivalent catalyst and adjunct content.

Although the mechanism responsible for this surprising reduction or elimination of sidestream smoke is not fully understood, it is thought that the use of an oxidation catalyst in cigarette paper increases the free-burn rate above the conventional free-burn rate. Without being bound to any certain theory, it is possible that the adjunct in combination with the catalyst affects not only the conventional free-burn rate but at the same time affects the heat transfer and mass transfer from the burning coal of the burning cigarette. It is possible that the adjunct, in combination with the catalyst, retards the rate at which the modified cigarette with catalyst would burn to now return the cigarette to a conventional free-burn rate. At this conventional free-burn rate, the catalyst is capable of achieving a significant conversion of sidestream smoke components to noticeably reduce visible sidestream smoke by greater than 50%, and normally greater than 80% and most preferably greater than 95%, as illustrated in the following examples.

EXAMPLES

Preamble

Cigarette Prototype 359-3 was furnished with double wrap of coated conventional cigarette paper. The loading of coating per treatment paper was 47 g/m$^2$. The functional ingredients in the coating comprises an oxygen donor and oxygen storage metal oxide oxidation catalyst, specifically cerium oxide co-mingled with or fixed to a suitable adjunct, specifically a Y-type zeolite CBV 720 from Zeolyst International of Valley Forge, Pa., U.S.A.

These functional ingredients were rendered suitable for coating on conventional cigarette paper through formulation with a standard coating package that included, but is not limited to, a wetting agent, pH enhancer, binder system, surfactant, and defoamer. For this example, 1 part total functional ingredient was formulated with 0.002 parts wetting agent, 0.06 parts pH enhancer, 0.18 parts binder system, 0.01 parts surfactant, and 0.00024 parts defoamer. Such coating packages are well known to those skilled in the field of coating.

The prepared cigarettes were smoked in a standard smoking machine. The amount of sidestream smoke was quantified visually on a scale of 0 to 8, 0 being no sidestream smoke and 8 being sidestream smoke as generated by a conventional cigarette.

Example 1

The treatment paper significantly reduces visual side stream smoke, up to 95% or more reduction versus a conventional cigarette. A strong correlation exists between visual side stream smoke and a number of quantifiable measurements of components of side stream smoke, for example, tar and nicotine levels. Side stream smoke measurements made on Prototype 359-3 following Health Canada Method T-212 (for determination of tar and nicotine in sidestream tobacco smoke show, in Table 1A a 96% reduction in side stream nicotine and a 73% reduction in side stream tar. This % reduction of tar correlates with a 95% reduction of visual side stream smoke as shown in Table 1B. Hence not all of the tar constituents need to be removed from the sidestream smoke to provide an essentially invisible stream of sidestream smoke. Gas Chromatography/Mass Spectrometer results of Table 1C are consistent with these measurements, showing an 82% reduction of aromatic hydrocarbons and an 88% reduction of nicotine in the side stream smoke. Sidestream smoke measurements on several prototypes are shown in Table 1D. The amount of sidestream smoke was quantified visually on a scale of 0 to 8, 0 being no sidestream smoke and 8 being sidestream smoke as generated by a conventional cigarette. Table 1D shows the amount of side stream smoke reduction in the prototypes as compared to the conventional cigarette and the correlation between the visual side stream smoke reduction and, subsequently, the consistent reduction in tar and nicotine. For example, a virtually imperceptable visual sidestream smoke reading of 0.5 corresponds to an amount of tar still remaining in the sidestream of about 6 mg per cigarette. Considerable experimentation in this area has revealed that there is an essentially linear relationship between sidestream smoke visual reading and the amount of tar remaining in the sidestream. For example, acceptable visual readings of about 2 corresponds with a tar content in the sidestream of about 10 mg. Generally, a visual reading above 2 is not preferred, although it is understood that there may be circumstances where a visual rating greater than 2 may be justified, for example, where less sidestream smoke reduction is desired.

Example 2

The treatment paper does not materially alter the main stream smoke. Main Stream Smoke Measurements on Prototype 359-3. The measurements are made using the following procedures:ISO Procedure, ISO 3308, see Fourth Ed., Apr. 15, 2000 (for measurement of routine analytical cigarette), ISO Procedure, ISO 4387, see Second Ed., Oct. 15, 1991 (for determination of total and nicotine-free dry particulate matter using a routine analytical smoking machine), ISO Procedure, ISO 10315, see First Ed., Aug. 1, 1991 (for determination of nicotine in smoke condensates—gas chromatographic method), ISO Procedure, ISO 10362-1, see Second Ed., Dec. 15, 1999 (for determination of water in smoke condensates—gas chromatographic method), ISO Procedure, ISO 3402, see Fourth Ed., Dec. 15, 1999 (atmosphere for conditioning and testing), ISO Procedure, ISO 8454, see Second Ed., Nov. 15, 1995 (for determination of carbon monoxide in the vapour phase of cigarette smoke—NDIR method, and it is shown in Table 2A that the nicotine and tar levels are substantially the same in the main stream compared to the levels in a conventional cigarette. Gas Chromatography/Mass Spectrometer results shown in Table 2B are consistent with these measurements. The measurable amounts of aromatic hydrocarbons are 150 micrograms per conventional cigarette versus 119 micrograms per Prototype 359-3. The measurable amounts of aromatic nitrogen containing compounds, specifically nicotine, are 1436 micrograms per conventional cigarette versus 1352 micrograms per Prototype 359-3. The measurable amounts of furan and derivatives are 159 micrograms per conventional cigarette versus 156 micrograms per Prototype 359-3. The measurable amounts of hydrocarbons are 202 micrograms per conventional cigarette versus 177 micrograms per Prototype 359-3. The measurable amounts of other carbonyls, specifically triacetin, are 478 micrograms per conventional cigarette and 674 micrograms per Prototype 359-3.

Example 3

The treatment paper is combustible, burns in a conventional manner, and ashes. The burning characteristics were measured quantitatively following the ISO Procedure, ISO 4387, see Second Ed., Oct. 15, 1991 (for determination of total and nicotine-free city particulate matter using a routine analytical smoking machine). Prototype 359-3, as shown in Table 3A, has an average puff count of 8.7 puffs per prototype compared to an average 9.5 puffs per conventional cigarette. The calculated burn rates show in Table 3A that Prototype 359-3 has substantially the same burn rate of 0.09 mm/sec as the conventional cigarette. Burn temperature profile measurements were taken in accordance with a technique described in published PCT application WO 99/53778, the subject matter of which is hereby incorporated by reference. The oxygen storage and donor metal oxide oxidation catalyst described in this published PCT application is typical of the oxygen storage and donor metal oxide oxidation catalyst described in this application. As taught in this published PCT application, the selected oxygen storage and donor metal oxide oxidation catalyst releases oxygen at free burn rate temperatures of a burning cigarette. Preferred oxygen storage and donor metal oxide oxidation catalyst are capable of releasing oxygen at elevated temperatures normally in the range of 400° C. to 550° C. The results of Table 3A are consistent with the above measurements, showing the Prototype burn characteristics both during the puff and the burn are substantially the same as the conventional cigarette. During puff, the control had a slightly lower temperature as measured at the paper surface, at the centreline of the cigarette and at a position ½ way along the radius of the cigarette. During burning, the paper temperature of the control and the Prototype 359-3 had essentially the same temperature.

Example 4

The coated treatment paper porosities were measured using procedures described in FILTRONA Operation Manual for Paper Permeability Meter PPM 100, and shown in Table 4A. The treatment paper used in furnishing Prototype 359-3 has a porosity of 9 Coresta. The coated treatment paper used in furnishing Cigarette Prototype 359-6 has a porosity of 32 Coresta. In Smoke Panel testing, Prototype 359-3 was found to have acceptable taste compared to a conventional cigarette with the same tobacco blend.

Prototype 359-6 was furnished in a similar double wrap manner to Prototype 359-3, as described in the Preamble. The loading of the coating per wrap was 34.5 g/m$^2$. The functional ingredients in the coating were identical to the functional ingredients listed in the Preamble, but included additional adjunct materials, ZSM-5 type zeolite CBV 2802 from Zeolyst, and Beta Type Zeolite CP-811 EL from Zeolyst.

These functional ingredients were rendered suitable for coating on conventional cigarette paper through formulation with a similar standard coating package as described in the preamble. For this coating package 1 part total functional ingredient was formulated with 0.002 parts wetting agent, 0.06 parts pH enhancer, 0.16 parts binder system, 0.01 parts surfactant, and 0.00024 parts defoamer.

Example 5

Different oxygen donor metal oxide oxidation catalyst are shown to be capable of reducing the side stream visual smoke to levels herein described. Referring to Table 5A, Prototype 2-143-1 shows ability of cerium oxide to function as both a high surface area adjunct and as an oxygen donor metal oxide oxidation catalyst. Prototype 2-143-2 shows the affects of high surface area cerium oxide co-mingled with Zeolite CBV 720 adjunct material to reduce visual side stream smoke. Prototype 2-133-3 shows the affects of the oxygen donor metal oxide oxidation catalyst iron oxide co-mingled with the high surface area CBV 720 adjunct material to reduce visual side stream smoke. At loadings of about one-half the loadings for the cerium based catalyst, iron oxide achieved a visual sidestream smoke reduction of about 2.5. It may be apparent that increasing the iron oxide loadings to the levels of the cerium oxide may achieve similar visible sidestream smoke reduction of about 1.0. It is readily apparent that by doubling the iron oxide and zeolite loadings to those levels of Prototypes 2-143-1 and 2-143-2, a similar visible sidestream smoke reduction of about 1.0. may be achieved.

Example 6

Particles ranging in an average diameter from 2 $\mu$m to more than 16 $\mu$m are capable of reducing the visual side stream smoke to the levels described in the previous examples. Although with a smaller particle size it is possible to apply lower coating loadings to meet the same visual side stream smoke levels as shown in Table 6A.

The functional ingredients in the coatings of Prototypes 2-50-1, 2-50-2, and 2-50-3 were identical to the functional ingredients listed in the preamble, only differing in the average particle size of the adjunct.

TABLE 1A

| | | Control [mg per cigarette] | 359-3 [mg per cigarette] | % reduction |
|---|---|---|---|---|
| Sidestream | Nicotine | 5.35 | 0.24 | 95.5 |
| | tar | 22.7 | 6.1 | 73.1 |

TABLE 1B

| | Control | 359-3 [mg per cigarette] | % reduction |
|---|---|---|---|
| Sidestream Visual (0 to 8) | 8 | 0.44 | 94.5 |

TABLE 1C

| Side Stream Semi-Volatiles | | Control [mg per cigarette] | 359-3 [mg per cigarette] | % reduction |
|---|---|---|---|---|
| Aromatic hydrocarbons | Hydroquinone | 175 | 31 | 82.3 |
| Aromatic nitrogen containing nicotine | | 5300 | 617 | 88.4 |

TABLE 1D

| | Side Stream - Visual (0–8) | Tar (mg/cigarette) | Nicotine (mg/cigarette) |
|---|---|---|---|
| 359-1 | 0.44 | | 0.33 |
| 359-3 | 0.44 | 6.1 | 0.24 |
| 359-4 | 0.44 | 6.5 | 0.33 |
| 359-2 | 0.56 | 6.3 | 0.37 |
| control | 8 | 22.7 | 5.35 |

TABLE 2A

| | | Control [mg per cigarette] | 359-3 [mg per cigarette] |
|---|---|---|---|
| Main Stream | nictone | 1.59 | 1.49 |
| | tar | 14.9 | 16.7 |

TABLE 2B

| Main Stream Semi-Volatiles | | Control [mg per cigarette] | 359-3 [mg per cigarette] |
|---|---|---|---|
| aromatic hydrocarbons | Hydroguinone | 90 | 82 |
| | Phenol | 60 | 37 |
| aromatic nitrogen containing nicotine | | 1436 | 1352 |
| furan and derivatives | 2-Furanmenthol | 16 | 12 |
| | 5-(O-Me)-2-furancarboxyaldehyde | 113 | 111 |
| | 5-methyl-2-furancarboxyaldehyde | 11 | 11 |
| | Furfural | 19 | 22 |
| | Limonene | 56 | 60 |
| | Neophytadiene | 146 | 117 |
| carbonyls | Triacetin | 478 | 674 |

TABLE 3A

| | Control | Prototype 359-3 |
|---|---|---|
| Is paper combustible? | Yes | Yes |
| ash formation | Good | Ashes, with peeling |
| # of puffs | 9.5 | 8.7 |
| free-burn rate[1] | 0.09 mm/sec | 0.09 mm/sec |

TABLE 3A-continued

| | Control | Prototype 359-3 |
|---|---|---|
| Burn temp profile | | |
| during puff paper temperature ° C. | 620 ± 20 | 690 ± 20 |
| centerline temperature ° C. | 810 ± 20 | 890 ± 20 |
| ½ radius temperature ° C. | 790 ± 20 | 880 ± 20 |
| During free burn paper temperature ° C. | 520 ± 20 | 500 ± 20 |

[1]free burn rate~(52 mm-butt length)/(60 sec*puff)
assume butt length = 3.0 mm

TABLE 4A

| | | |
|---|---|---|
| Base Paper | KC-514 | KC-514 |
| Prototype # | 359-3 | 359-6 |
| Formula # | 2-13-2 | 2-99-1 |
| *Paper Coating | DS | DS |
| Coating Load (g/m2) - Per Paper | 47.4 | 34.5 |
| Basis Wt. (Single Paper + Coating) | 72.4 | 69.0 |
| Basis Wt. Per Cigarette | 72.4 × 2 | 69.0 × 2 |
| Coated Paper Porosity (Coresta) | 9 | 32 |
| FUNCTIONAL INGREDIENTS | | |
| CBV 720 Zeolite with attached cerium oxide | 100 | 75 |
| CBV 2802 Zeolite | | 12.5 |
| CP-811EL Zeolite | | 12.5 |
| STANDARD COATING PACKAGE (SEE PREAMBLE) | | |
| BURNING CHARACTERISTICS | | |
| Temp | 384 | 339 |
| Puffs | 9 | 9.3 |
| Side Stream - Visual (0–8) | 1 | 2.7 |

KC 514 Base Paper (Schweitzer-Mauduit International of Alpharetta, Georgia U.S.A.) has basis weight of 25 g/m$^2$, and a starting porosity before coating of 50 Coresta units.
*DS-Double Paper, Single Coating (Sandwich Style)

TABLE 5A

| | | | |
|---|---|---|---|
| Base Paper | KC-514 | KC-514 | KC-514 |
| Formula # | 2-143-1 | 2-143-2 | 2-133-3 |
| Coating Load (g/m$^2$)- Per Paper | 54 | 49 | 53.5 |
| Basis Wt. (Single Paper + Coating) | 79 | 73 | 78.5 |
| Basis Wt. Per Cigarette | 158 | 146 | 78.5 |
| FUNCTIONAL INGREDIENTS | | | |
| Cerium oxide | 100 | 44 | |
| CBV 720 Zeolite | | 56 | |
| CBV 720 Zeolite with 1% FeO (2-132-4) | | | 100 |
| STANDARD COATING PACKAGE (SEE PREAMBLE) | | | |
| BURNING CHARACTERISTICS | | | |
| Temp | 366 | 357 | 352 |
| Puffs | 7.0 | 8.3 | 8.3 |
| Side Stream - Visual (0–8) | 1.3 | 1.0 | 2.5 |

TABLE 6A

| FUNCTIONAL | Coated Handsheet Formula # | | |
|---|---|---|---|
| INGREDIENTS | 2-50-1 | 2-50-2 | 2-50-4 |
| CBV 720 Zeolite co-mingled cerium oxide | 100 | 100 | 100 |
| Average Particle size of adjunct material | 2 μm | 4 μm | 16 μm |

TABLE 6A-continued

| FUNCTIONAL | Coated Handsheet Formula # | | |
|---|---|---|---|
| INGREDIENTS | 2-50-1 | 2-50-2 | 2-50-4 |
| Amount of material need to reduce visual side stream to 3. | 48 g/m$^2$ | 95 g/m$^2$ | 120 g/m$^2$ |

Although preferred embodiments of the invention have been described herein in detail, it will be understood by those skilled in the art that variations may be made thereto without departing from the spirit of the invention or the scope of the appended claims.

What is claimed is:

1. A low sidestream smoke cigarette comprising a conventional tobacco rod, and a combustible treatment paper having a sidestream smoke treatment composition, said treatment composition comprising in combination, an oxygen storage and donor metal oxide oxidation catalyst and an essentially non-combustible finely divided porous particulate adjunct for said catalyst where said oxygen storage and donor metal oxide oxidation catalyst releases oxygen at free burn rate temperatures for said cigarette.

2. A cigarette of claim 1, wherein said adjunct has an average particle size of less than about 30 μm.

3. A cigarette of claim 2, wherein said adjunct is a high surface area porous material with a surface area in excess of about 20 m$^2$/g and an average particle size greater than about 1 μm.

4. A cigarette of claim 3 wherein said catalyst is a finely divided particulate with an average particle size less than about 30 μm.

5. A cigarette of claim 3 wherein said catalyst has an avenge particle size of less than about 1 μm when said catalyst particles are fixed to surfaces of said adjunct.

6. A cigarette of claim 5, wherein the relative amounts of said catalyst fixed to said adjunct ranges from about 1 to 75% by weight based on the total equivalent catalyst and adjunct content.

7. A cigarette of claim 6, wherein the relative amounts of said catalyst fixed to said adjunct ranges from about 20 to 70% by weight based on the total equivalent catalyst and adjunct content.

8. A cigarette of claim 3, wherein said adjunct is selected from the group consisting of clays, essentially non-combustible milled fibres, monolithic mineral based materials, essentially non-combustible activated carbon, zeolites and mixtures thereof.

9. A cigarette of claim 8, wherein said non-combustible milled fibres are selected from the group consisting of zirconium fibres, zirconium/cerium fibres, ceramic fibres, carbon fibres and mixtures thereof.

10. A cigarette of claim 8, wherein said monolithic mineral based materials are selected from the group consisting of zirconium oxides, titanium oxides and cerium oxides and mixtures thereof.

11. A cigarette of claim 8, wherein said zeolites are, represented by the formula $$M_mM'_nM''_p[aAlO_2 \cdot b\ SiO_2 \cdot cTO_2]$$

wherein

M is a monovalent cation,

M' is a divalent cation,

M" is a trivalent cation, a, b, c, n, m and p we numbers which reflect the stoichiometric proportions, c, m, a or p can also be zero, Al and Si are tetrahedrally coordinated Al and Si atoms, and T is a tetrahedrally coordinated metal atom being able to replace Al or Si, wherein the ratio of b/a of the zeolite or the zeolite-like material, has a value of about 5 to about 300 and the micropore size of the zeolite is within the range of about 0.5 to 1.3 nm (5 to 13 Å).

12. A cigarette of claim 8, wherein said zeolite is selected from the group consisting of silicalite zeolites, faujasites, X, Y and L zeolites, beta-zeolites, Mordenite zeolites, ZSM zeolites and mixtures thereof.

13. A cigarette of claim 8 wherein said porous adjunct has pores to provide said surface areas in excess of about 20 $m^2/g$.

14. A cigarette of claim 13, wherein said pores have an average diameter of less than about 20 nm.

15. A cigarette of claim 14, wherein said porous adjunct has an average particle size of about 1 $\mu$m to about 5 $\mu$m.

16. A cigarette of claim 1, wherein said catalyst is selected from the group consisting of a transition metal oxide selected from the group consisting of group VB, VIB, VIIB, VIII, IB metal oxides and mixtures thereof; a rare earth metal oxide and mixtures thereof; and a mixture of said transition metal oxide and said rate earth metal oxide.

17. A cigarette of claim 16 wherein said rare earth metal oxide are selected from the group consisting of oxides of scandium, yttrium, lanthanum, lanthanide metals and mixtures thereof.

18. A cigarette of claim 17, said lanthanide metal oxide is cerium oxide.

19. A cigarette of claim 18, wherein said cerium oxide is admixed with zeolite as said adjunct.

20. A cigarette of claim 18, wherein said cerium oxide is provided as a layer adjacent to a layer of zeolite.

21. A cigarette of claim 18, wherein said composition comprises cerium oxide particles fixed to surfaces of zeolite particles.

22. A cigarette of claim 18, wherein a metal or metal oxide oxidation catalyst is used with said cerium oxide, said metal or metal oxide oxidation catalyst being selected from the group consisting of oxides of precious metals, transition metals, rare earth metals, metals from groups IIA and IVA and mixtures thereof.

23. A cigarette of claim 22 wherein said selected metal or metal oxide oxidation catalyst is selected from the group consisting of platinum, palladium, copper oxide) iron oxide, magnesium oxide, silver oxide, titanium oxide, zirconium oxide and mixtures thereof.

24. A cigarette of claim 1, wherein said catalyst is a mixture of a rare earth metal oxide and a transition metal oxide, said transition metal oxide being selected from the group consisting of group IVB, VB, VIB, VITB, VIII, IB metal oxides and mixtures thereof.

25. A cigarette of claim 24 said transition metal oxide is iron oxide.

26. A cigarette of claim 1, wherein said treatment composition is a coating on said cigarette paper.

27. A cigarette of claim 26, wherein said cigarette paper is double wrapped on said tobacco rod.

28. A cigarette of claim 26, wherein said treatment composition is incorporated within said treatment paper at a loading rate of about 2.5 $g/m^2$ to about 125 $g/m^2$.

29. A cigarette of claim 28, wherein said treatment composition is incorporated onto said paper at a loading rate of about 2.5 $g/m^2$ to about 100 $g/m^2$.

30. A cigarette of claim 1, wherein said treatment composition is impregnated into said cigarette paper.

31. A cigarette of claim 30, wherein said cigarette paper is double wrapped on said tobacco rod.

32. A cigarette of claim 1, wherein said treatment composition is incorporated in said cigarette paper during the cigarette paper manufacture.

33. A cigarette of claim 32, wherein said cigarette paper is additionally coated with an oxidation catalyst.

34. A cigarette of claim 33, wherein said cigarette paper is double wrapped on said rod.

35. A cigarette of claim 34, wherein said average particle size is less than about 5 $\mu$m.

36. A cigarette of claim 32, wherein said cigarette paper is double wrapped on said tobacco rod.

37. A cigarette of claim 1, wherein said treatment composition is incorporated with said combustible paper from about 10% to about 500% by weight.

38. A cigarette of claim 1, wherein said treatment composition has an adjunct and catalyst average article size less than about 30 $\mu$m.

39. A cigarette of claim 1, wherein said treatment composition is applied as a coating to said treatment paper by use of a coating die, coating head, slot die or roll coater.

40. A cigarette of claim 1, wherein said treatment composition is impregnated into said treatment paper by use of pressurized roll costar.

41. A cigarette of claim 1 further comprising a processing aid selected from the group consisting of zirconium fibres and zirconium/cerium fibres.

42. A low sidestream smoke cigarette comprising a conventional tobacco rod, and a combustible treatment paper having a sidestream smoke treatment composition, said treatment composition comprising in combination, an oxygen storage and donor metal oxide oxidation catalyst and an essentially non-combustible finely divided porous particulate adjunct for said catalyst where said oxygen storage and donor metal oxide oxidation catalyst releases oxygen at free burn rate temperatures for said cigarette and wherein a first amount of cerium oxide in said treatment composition is said particulate adjunct and a second amount of said cerium oxide in said treatment composition is said oxygen donor catalyst.

43. A tow sidestream smoke cigarette comprising a conventional tobacco rod, and a combustible treatment paper having a sidestream smoke treatment composition comprising cerium oxide which functions both as an oxygen storage and donor metal oxide oxidation catalyst and an essentially non-combustible finely divided porous particulate adjunct for said catalyst, where said cerium oxide releases oxygen at free burn rate temperatures of said cigarette.

44. A cigarette of claim 43, wherein said essentially non-combustible finely divided porous particulate adjunct is non-combustible milled fibres selected from the group consisting of zirconium fibres, zirconium/cerium fibres, ceramic carbon fibres and mixtures thereof.

45. A cigarette of claim 43 further comprising a processing aid selected from the group consisting of zirconium fibres and zirconium fibres.

46. A combustible cigarette paper for use on a smokable tobacco rod of a cigarette for reducing sidestreamn smoke emitted from a burning cigarette, said cigarette treatment paper including a sidestream smoke treatment composition comprising in combination an oxygen storage and donor metal oxide oxidation catalyst and an essentially non-combustible finely divided porous particulate adjunct where said oxygen storage and donor metal oxide oxidation catalyst releases oxygen at free burn rate temperatures of a cigarette made from said cigarette paper.

47. A cigarette paper of claim 46, wherein said catalyst and said adjunct have an average particle size less than about 3 $\mu$m.

48. A cigarette paper of claim 47, wherein said adjunct is selected from the group consisting of clays, essentially non-combustible milled fibres, monolithic mineral based materials, essentially non-combustible activated carbon, zeolites and mixtures thereof, and said catalyst is selected from the group consisting of a transition metal oxide selected from the group consisting of group VB, VIB, VUB, VIII, IB metal oxides and mixtures thereof; a rare earth metal oxide and mixtures thereof; and a mixture of said transition metal oxide and said rare earth metal oxide.

49. A cigarette paper of claim 47, wherein said adjunct is selected from the group consisting of clays, essentially non-combustible milled fibres, monolithic mineral based materials, essentially non-combustible activated carbon zeolites and mixtures thereof, and said catalyst is a mixture of a rue earth metal oxide and a transition metal oxide, said transition metal oxide being selected from the group consisting of group IVB, VB, VI, VIIB, VIII, IB metal oxides and mixtures thereof, and said rare earth metal oxide being selected from the group consisting of oxides of scandium, yttrium, lanthanum, and lanthanide metal oxides and mixtures thereof.

50. A cigarette paper of claim 49, wherein said catalyst is cerium oxide and said adjunct is a zeolite.

51. A cigarette paper of claim 49, wherein said treatment composition is incorporated with said paper from about 10% to about 500% by weight.

52. A cigarette paper of claim 48, wherein said essentially non-combustible finely divided porous particulate adjunct is non-combustible milled fibres selected from the group consisting of zirconium fibres, zirconium/cerium fibres, ceramic fibres, carbon fibres and mixtures thereof.

53. A cigarette paper of claim 48, further comprising a processing aid selected from the group consisting of zirconium fibres and zirconium/cerium fibres.

54. A method for reducing sidestream smoke emitted from a burning cigarette, comprising treating sidestream smoke with a treatment composition carried by a combustible cigarette paper, said treatment composition comprising in combination, an oxygen storage and donor metal oxide oxidation catalyst and an essentially non-combustible finely divided porous particulate adjunct for said catalyst, said oxygen storage and donor metal oxide oxidation catalyst releasing oxygen at free barn rate temperatures of said burning cigarette.

55. A method of claim 54, wherein said catalyst and said adjunct have an average particle size less than about 30 $\mu$m.

56. A method of claim 55, wherein said adjunct is selected from the group consisting of clays, essentially non-combustible milled carbon or ceramic fibres, monolithic mineral based materials, essentially non-combustible activated carbon, zeolites and mixtures thereof, and said catalyst is selected from the group consisting of a transition metal oxide selected from the group consisting of group VB, VIB, VIIB, VIII, IB metal oxides and mixtures thereof; a rare earth metal oxide and mixtures thereof and a mixture of said transition metal oxide and said rare earth metal oxide.

57. A method of claim 55, wherein said adjunct is selected from the group consisting of clays, essentially non-combustible milled carbon or ceramic fibres, monolithic mineral based materials, essentially non-combustible activated carbon, zeolites and mixtures thereof, and said catalyst is a mixture of a rare earth metal oxide and a transition metal oxide, said transition metal oxide being selected from the poop consisting of group IVB, VB, VIB, VIIB, VII, IB metal oxides and mixtures thereof, and said rue earth metal oxide being selected from the group consisting of scandium, yttrium, lanthanum, mid lanthanide metal oxides and mixtures thereof.

58. A method of claim 56, wherein said treatment composition is incorporated with said paper from about 10% to about 500% by weight.

59. A method of claim 56, wherein said adjunct has a surface area greater than about 20 $m^2/g$, said sidestream smoke being selectively adsorbed by said adjunct and oxidized by said catalyst to produce turn-visible sidestream smoke emanating from said burning cigarette, said catalyst donating oxygen to assist in maintaining conventional free-burn rates and burn temperature.

60. A method of claim 59, wherein said catalyst is cerium oxide and said adjunct is a zeolite.

61. A method of claim 54, wherein said daily non-combustible finely divided porous particulate adjunct selected from consisting of zirconium fibres, zirconium/cerium fibres, ceramic fibres, carbon fibres aid mixtures thereof.

62. A method of claim 54, wherein said treatment composition further comprises a processing aid selected from the group consisting of zironium fibers and zirconium/cerium fibres.

63. A low sidestream smoke cigarette comprising a conventional tobacco rod, and a combustible treatment paper having a sidestream smoke treatment composition, said treatment composition comprising in combination, an oxygen storage and donor metal oxide oxidation catalyst and an essentially non-combustible zeolite adjunct for said catalyst, said oxygen storage and donor metal oxide oxidation catalyst releasing oxygen at free burn rate temperatures of said cigarette.

64. A cigarette of claim 63, wherein said catalyst is selected from the group consisting of a transition metal oxide, selected from the group consisting of group VB, VIB, VIIB, VIII, IB metal oxides and mixtures thereof; a rare earth metal oxide and mixtures thereof; and a mixture of said transition metal oxide and said rare earth metal oxide.

65. A cigarette of claim 64, wherein said catalyst is a mixture of a rare earth metal oxide and a transition metal oxide, said transition metal oxide being selected from the group consisting of group IVB, VB, VIB, VIIB, VIII, IB metal oxides and mixtures thereof.

66. A cigarette of claim 65 wherein said rare earth metal oxide are selected from the group consisting of oxides of scandium, yttrium, lanthanum, lanthanide metals and mixtures thereof.

67. A cigarette of claim 66, wherein said lanthanide metal oxide is cerium oxide.

68. A method of claim 64, further comprising a processing aid selected from the group consisting of zirconium fibres and zirconium/cerium fibres.

* * * * *

UNITED STATES PATENT AND TRADEMARK OFFICE

CERTIFICATE OF CORRECTION

PATENT NO. : 6,799,578 B2
DATED : October 4, 2004
INVENTOR(S) : Stanislav M. Snaidr et al.

It is certified that error appears in the above-identified patent and that said Letters Patent is hereby corrected as shown below:

Title page,
Item [56], References Cited, U.S. PATENT DOCUMENTS, please replace "3,220,416" with -- 3,220,418 --.

Column 19,
Line 1, please replace "a" with -- n --.
Line 48, please replace "copper oxide)" with -- copper oxide, --.
Line 54, please replace "VITB" with -- VIIB --.

Column 20,
Line 20, please replace "article" with -- particle --.
Line 59, please replace "zirconium" with -- zirconium/cerium --.

Column 21,
Line 5, please replace "3" with -- 30 --.
Line 12, please replace "VUB" with -- VIIB --.
Line 19, please replace "carbon" with -- carbon, --.
Line 23, please replace "VI" with -- VIB --.
Line 33, please replace "claim 48" with -- claim 46 --.
Line 38, please replace "claim 48" with -- claim 46 --.
Line 64, please replace "claim 55" with -- claim 56 --.

Column 22,
Line 24, please replace "daily" with -- essentially --.
Line 26, please replace "selected from consisting" to -- is non-combustible milled fibres selected from the group consisting --.

UNITED STATES PATENT AND TRADEMARK OFFICE

CERTIFICATE OF CORRECTION

PATENT NO. : 6,799,578 B2
DATED : October 4, 2004
INVENTOR(S) : Stanislav M. Snaidr et al.

It is certified that error appears in the above-identified patent and that said Letters Patent is hereby corrected as shown below:

Column 22 (cont'd),
Line 27, please replace "aid" with -- and --.
Line 60, please replace "claim 64" with -- claim 63 --.

Signed and Sealed this

Eighteenth Day of October, 2005

JON W. DUDAS
*Director of the United States Patent and Trademark Office*

UNITED STATES PATENT AND TRADEMARK OFFICE

CERTIFICATE OF CORRECTION

PATENT NO. : 6,799,578 B2
DATED : October 5, 2004
INVENTOR(S) : Stanislav M. Snaidr et al.

It is certified that error appears in the above-identified patent and that said Letters Patent is hereby corrected as shown below:

Column 18,
Line 35, replace “avenge” with -- average --.

Column 19,
Lines 59 and 60, replace “cigarette” with -- treatment --.

Column 20,
Lines 2, 3, 6, 7, 8, 10 and 14, replace “cigarette” with -- treatment --.
Line 27, replace “costar.” with -- coater. --.
Line 61, replace “sidestreamn” with -- sidestream --.

Column 21,
Line 21, replace “rue” with -- rare --.
Line 49, replace “barn” with -- burn --.
Line 61, replace “thereof” with -- thereof; --.

Column 22,
Line 6, replace “poop” with -- group --.
Line 7, replace “rue” with -- rare --.
Line 18, replace “turn-visible” with -- non-visible --.
Line 32, replace “zironium” with -- zirconium --.
Line 60, replace “method” with -- cigarette --.

Signed and Sealed this

Twenty-first Day of February, 2006

JON W. DUDAS
*Director of the United States Patent and Trademark Office*